US008044983B2

(12) United States Patent
Nonaka et al.

(10) Patent No.: US 8,044,983 B2
(45) Date of Patent: Oct. 25, 2011

(54) VIDEO DISPLAY APPARATUS

(75) Inventors: Ryosuke Nonaka, Kawasaki (JP); Masahiro Baba, Yokohama (JP); Yuma Sano, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/876,298

(22) Filed: Sep. 7, 2010

(65) Prior Publication Data

US 2011/0043547 A1 Feb. 24, 2011

Related U.S. Application Data

(63) Continuation of application No. PCT/JP2009/059069, filed on May 15, 2009.

(51) Int. Cl.
*G09G 5/10* (2006.01)

(52) U.S. Cl. ..... 345/690; 345/87; 345/102; 349/1; 362/611

(58) Field of Classification Search ..... 345/87, 345/102, 690; 349/1, 5, 6; 362/611, 612; 382/284, 260, 274, 275
See application file for complete search history.

(56) References Cited

U.S. PATENT DOCUMENTS

| | | | | |
|---|---|---|---|---|
| 5,438,484 | A * | 8/1995 | Kanda et al. | 362/613 |
| 2006/0214904 | A1 * | 9/2006 | Kimura et al. | 345/102 |
| 2007/0159448 | A1 * | 7/2007 | Inuzuka et al. | 345/102 |
| 2008/0111784 | A1 | 5/2008 | Tanaka et al. | |
| 2009/0289879 | A1 * | 11/2009 | Ito et al. | 345/87 |
| 2009/0303744 | A1 * | 12/2009 | Iwasaki | 362/612 |
| 2010/0039440 | A1 * | 2/2010 | Tanaka et al. | 345/589 |
| 2010/0141571 | A1 * | 6/2010 | Chiang et al. | 345/102 |

FOREIGN PATENT DOCUMENTS

| | | |
|---|---|---|
| JP | 2002-99250 | 4/2002 |
| JP | 2007-183499 | 7/2007 |
| JP | 2007-322944 | 12/2007 |
| JP | 2008-122713 | 5/2008 |

* cited by examiner

*Primary Examiner* — Kimnhung Nguyen
(74) *Attorney, Agent, or Firm* — Oblon, Spivak, McClelland, Maier & Neustadt, L.L.P.

(57) ABSTRACT

According to one embodiment, a video display apparatus includes a liquid crystal panel configured to display a video on a display area and light sources, each configured to be controlled respectively and to light in an illumination area into which the display area is virtually divided according as arrangement of the light sources. The apparatus includes a first calculation unit configured to calculate a second emission intensity corresponding to a small-area based on a video signal in a small-area, wherein the small-area is segmented area of the display area and smaller than the illumination area. The apparatus includes a second calculation unit configured to calculate a first emission intensity to control the light source from the second emission intensities and a control unit configured to light the light sources at the first emission intensities.

6 Claims, 15 Drawing Sheets

VIDEO DISPLAY APPARATUS

CROSS REFERENCE TO RELATED APPLICATIONS

This is a Continuation Application of PCT Application No. PCT/JP2009/059069, filed May 15, 2009, which was published under PCT Article 21(2) in Japanese.

FIELD

Embodiments described herein relate generally to control of emission intensity of a backlight to illuminate a liquid crystal panel.

BACKGROUND

A liquid crystal display (LCD) displays a desired video by modulating illumination light from a backlight through a liquid crystal panel. Light sources may be included in the backlight. Furthermore, the emission intensities of the light sources included in the backlight need not be uniform but may be individually controlled. The individual control of emission intensities of the light sources is expected to exert effects such as an expansion in display dynamic range and a reduction in power consumption.

For example, a transmissive display apparatus described in JP-A 2008-122713 (KOKAI) controls backlight luminances corresponding to respective areas into which a display screen of a liquid crystal panel is divided. Specifically, the transmissive display apparatus described in JP-A 2008-122713 (KOKAI) determines the backlight luminance corresponding to each area based on the maximum video signal value in the area.

The transmissive display apparatus described in JP-A 2008-122713 (KOKAI) determines a representative value based on video signals contained in each of the areas (luminous areas) in which the backlight luminance can be individually controlled. Based on the representative value, the transmissive display apparatus determines the backlight luminance. Such control of the backlight luminance may cause an observer to perceive unnatural variation in luminance.

For example, if a video of fireworks is to be displayed, then in the video to be displayed, a bright (high luminance) object (hereinafter referred to as a bright point) moves gradually against a dark (low luminance) background. According to the conventional control of the backlight luminance as described above, luminous areas containing the bright point are provided with a high backlight luminance. Luminous areas containing no bright point are provided with a low backlight luminance. During the movement, every time the bright point strides over the boundary between the luminous areas, the magnitude of the backlight intensity is reversed. That is, the backlight luminance of the luminous area into which the bright point flows increases rapidly. The backlight luminance of the luminous area out of which the bright point flows decreases rapidly. Such a variation in backlight luminance can be perceived by the observer, who may feel uncomfortable with the display.

DETAILED DESCRIPTION

In general, according to one embodiment, a video display apparatus includes a liquid crystal panel configured to display a video on a display area and light sources, each configured to be controlled respectively and to light in an illumination area into which the display area is virtually divided according as arrangement of the light sources. The apparatus includes a first calculation unit configured to calculate a second emission intensity corresponding to a small-area based on a video signal in a small-area, wherein the small-area is segmented area of the display area and smaller than the illumination area. The apparatus includes a second calculation unit configured to calculate a first emission intensity to control the light source from the second emission intensities and a control unit configured to light the light sources at the first emission intensities.

Embodiments will be described below with reference to the drawings.

First Embodiment

Figure 1:
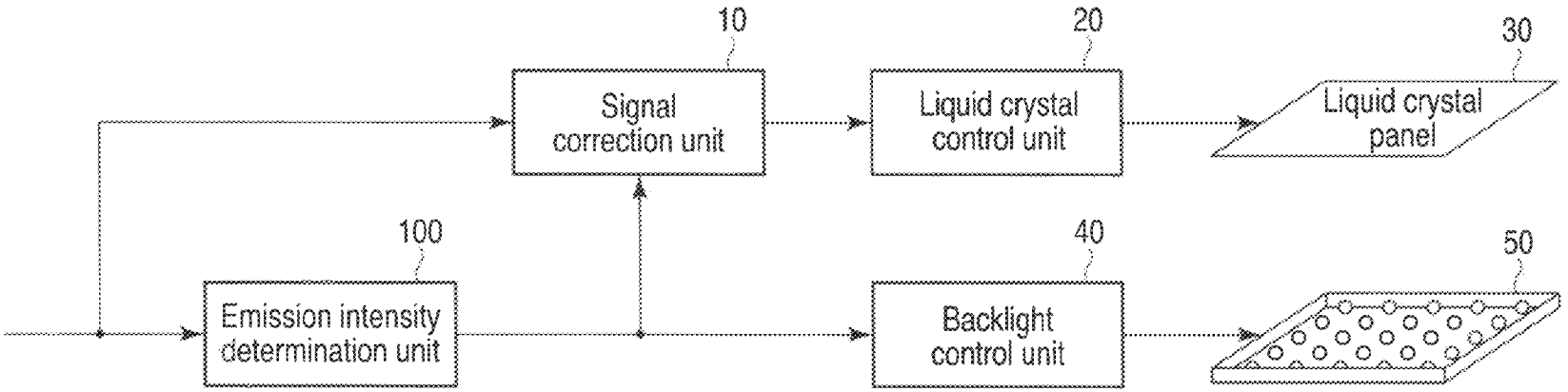
FIG. 1 is a block diagram showing a liquid crystal display apparatus according to a first embodiment.

As shown in FIG. 1, a video display apparatus according to a first embodiment includes a signal correction unit 10, a liquid crystal control unit 20, a liquid crystal panel 30, a backlight control unit 40, a backlight 50, and an emission intensity determination unit 100.

Figure 2A:
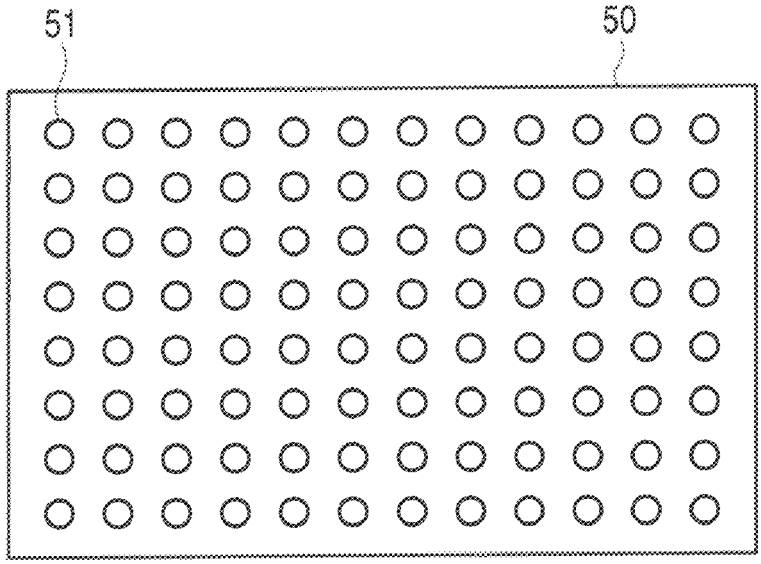
FIG. 2A is a diagram showing an example of an aspect of a backlight in FIG. 1.
Figure 2B:
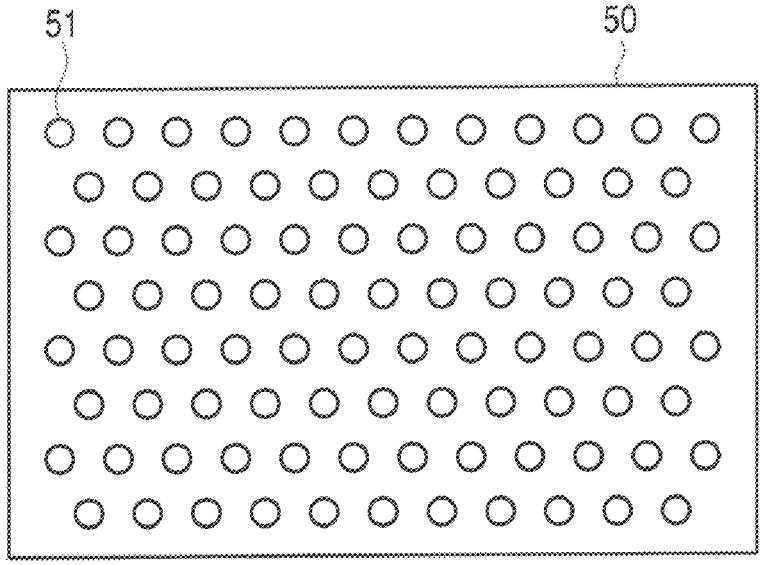
FIG. 2B is a diagram showing an example of an aspect of the backlight in FIG. 1.
Figure 2C:
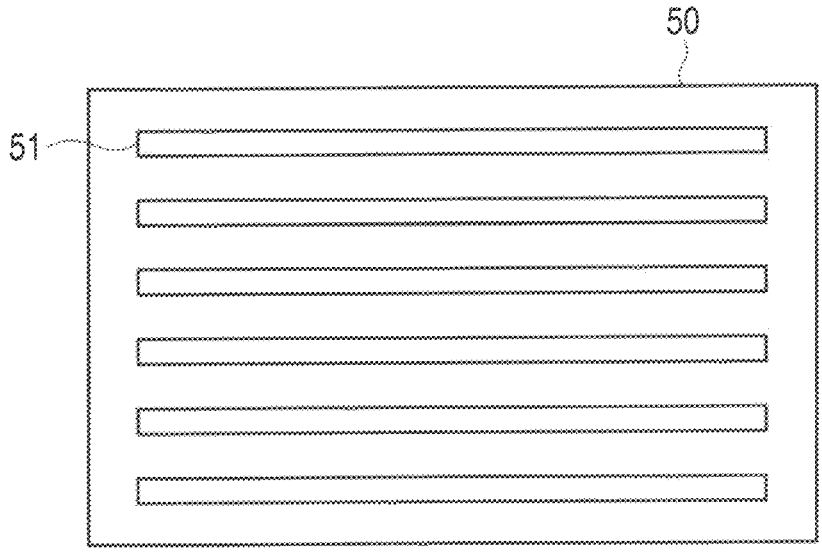
FIG. 2C is a diagram showing an example of an aspect of the backlight in FIG. 1.
Figure 2D:
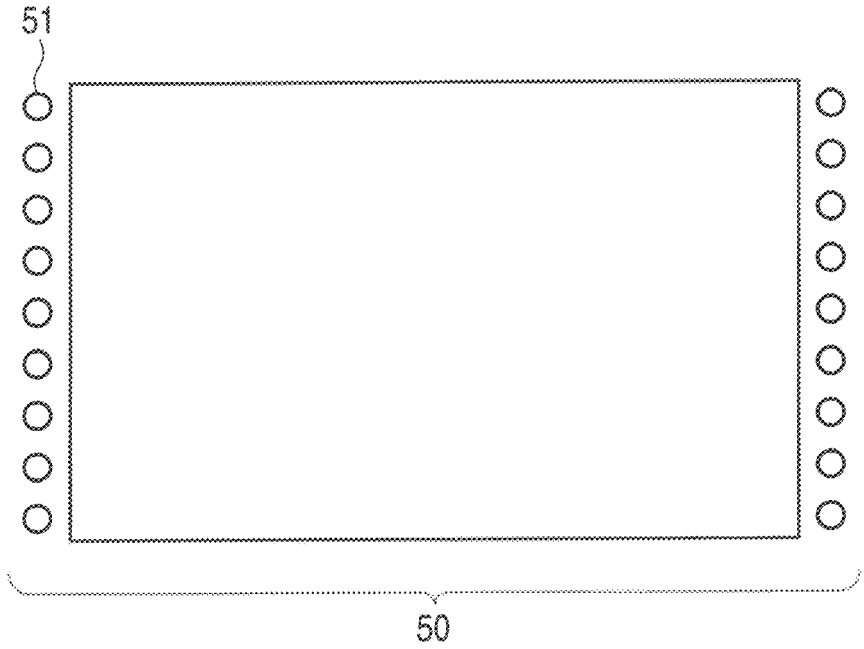
FIG. 2D is a diagram showing an example of an aspect of the backlight in FIG. 1.
Figure 3:
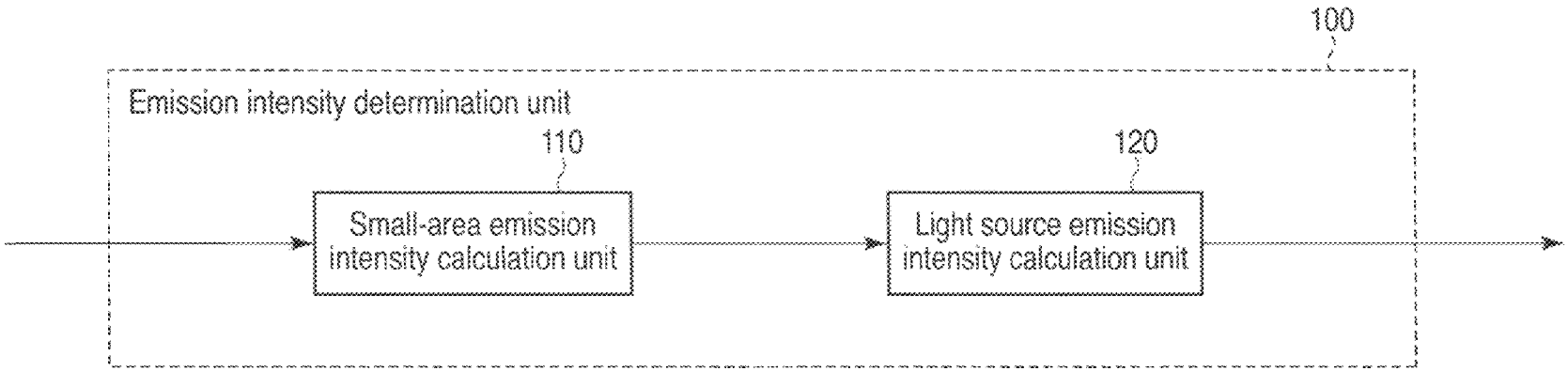
FIG. 3 is a diagram showing an emission intensity determination unit in FIG. 1.

The backlight 50 illuminates the liquid crystal panel 30 in accordance with control performed by the backlight control unit 40. The backlight 50 includes light sources 51 capable of individually controlling emission intensity. The backlight 50 may be implemented by any existing or future structure. For example, as shown in FIG. 2A and FIG. 2B, the backlight 50 may include dot-like light sources 51 distributed so as to directly illuminate the rear surface of the liquid crystal panel 30. Alternatively, as shown in FIG. 2C, the backlight 50 may include bar-like light sources 51 arranged in parallel so as to directly illuminate the rear surface of the liquid crystal panel 30. The scheme in which the light sources 51 are arranged as shown in FIGS. 2A to 2C is called a direct type. On the other hand, as shown in FIG. 2D, the light sources 51 may be arranged in accordance with what is called an edge light scheme. In the edge light scheme, the light sources 51 are arranged along the side of the liquid crystal panel 30 rather than on the rear surface of the liquid crystal panel 30. Illumination light from the light sources 51 is guided to the rear surface of the liquid crystal panel 30 by a light guide plate or a reflector (not shown in FIG. 2D).

Each of the light sources 51 may include a single light-emitting element or a group of light-emitting elements arranged such that they are spatially proximate to one another. Furthermore, LEDs, cold cathode fluorescent lamps, or hot cathode fluorescent lamps are applicable as the light-emitting elements included in the light source 51. However, the light-emitting elements are not limited to these examples. In particular, LEDs are suitable as light-emitting elements because of a wide range between the maximum luminance and minimum luminance at which the LED can emit light, allowing a wide dynamic range to be easily realized. The light sources 51 have their emission intensities (emission luminances) and emission timings individually controlled by the backlight control unit 40.

The backlight control unit 40 lights the light sources 51 at predetermined emission timings in accordance with the emission intensities of the light sources 51 determined by the emission intensity determination unit 100.

An emission intensity determination unit 100 determines the emission intensity of each of the light sources 51 based on an input video signal. The emission intensity determination unit 100 inputs the emission intensity to a signal correction unit 10 and the backlight control unit 40. Specifically, the emission intensity determination unit 100 carries out a two-step emission intensity calculation process to determine the emission intensity of each of the light sources 51. The emission intensity determination unit 100 includes a small-area emission intensity calculation unit 110 and a light source emission intensity calculation unit 120 to perform a corresponding part of the two-step emission intensity calculation process, respectively.

Based on an input video signal, the small-area emission intensity calculation unit 110 calculates emission intensities to be assigned to the small-areas. Here, the small-areas refer to the areas into which the display area of the liquid crystal panel 30 is spatially divided. On the other hand, compared to the small-areas, the term "illumination area" is used in the specification. The illumination area refers to an area of the liquid crystal panel 30 which is illuminated by each light source 51. The term "illuminate" as used herein substantially means "mainly illuminate". That is, one illumination area may be partly illuminated with illumination light from the light source 51 corresponding to another illumination area. In other words, the illumination areas are areas into which the display area of the liquid crystal panel 30 is virtually divided in accordance with the spatial arrangement of the light sources 51. The above-described small-areas are areas into which the display area of the liquid crystal panel 30 is divided and each of which is smaller than the illumination area.

Figure 4:
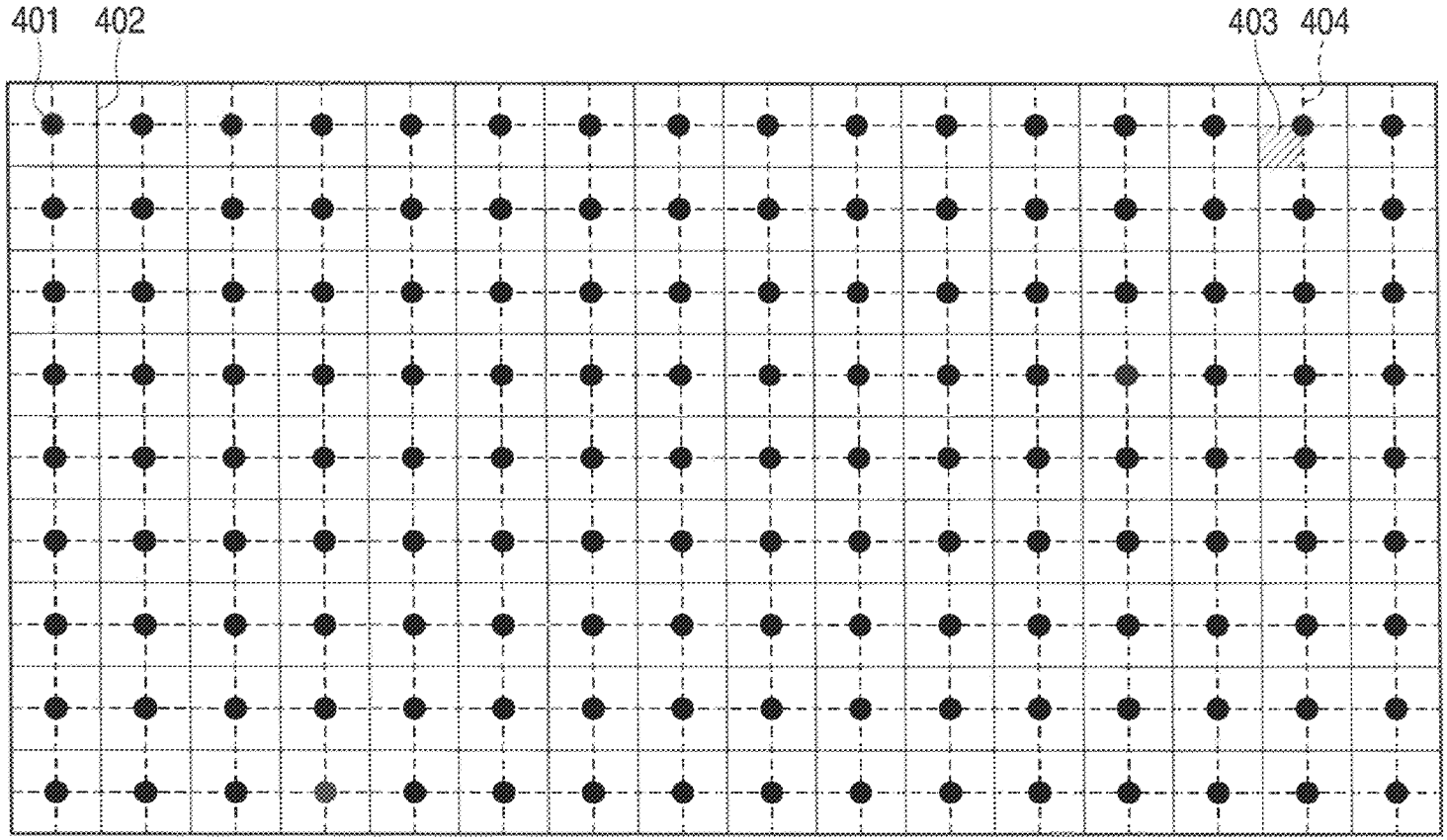
FIG. 4 is a diagram illustrating small-areas and illumination areas to be processed by the emission intensity determination unit in FIG. 3.

For example, in FIG. 4, illumination areas 401 (the center of each illumination area is shown as a black circle) corresponding to the respective light sources 51 are obtained by virtually dividing the display area of the liquid crystal panel 30 by illumination area boundaries 402 (shown by solid lines) in accordance with the spatial arrangement of the light sources 51. The small-areas 403 (for example, shown as shaded areas) are obtained by dividing the display area of the liquid crystal panel 30 by small-area boundaries 404 (shown by dashed lines), and are each smaller than the illumination area 401.

The small-area emission intensity calculation unit 110 calculates the emission intensity of each small-area based on a video signal for a calculation area corresponding to the small-area. Here, the calculation area may be the same as the small-area or may include one part of the small-area but not any other part. Alternatively, the calculation area may include the entire small-area and another peripheral area. Alternatively, the technique for determining the calculation areas may vary among small-areas. In other words, the calculation area is any area required to calculate the emission intensity of the corresponding small-area.

An example of the small-area emission intensity calculation unit 110 will be described with reference to FIG. 5. The small-area emission intensity calculation unit 110 in FIG. 5 includes a maximum-value calculation unit 111 and a gamma conversion unit 112.

The maximum-value calculation unit 111 calculates the maximum video signal value in the calculation area corresponding to each small-area. That is, the maximum-value calculation unit 111 calculates the maximum video signal value in the calculation area. The maximum-value calculation unit 111 inputs the maximum video signal value to the gamma conversion unit 112.

The gamma conversion unit 112 carries out gamma conversion on the maximum video signal value from the maximum-value calculation unit 111. Specifically, in the gamma conversion, the gamma conversion unit 112 converts a video signal value into a relative luminance. For example, if the variance range of the video signal value is at least 0 and at most 255 (8 bit value), the gamma conversion unit 112 carries out gamma conversion in accordance with:

$$L = (1-\alpha)\left(\frac{S}{255}\right)^{\gamma} = \alpha \tag{1}$$

In Expression (1), $\alpha$ and $\gamma$ denote constants, S denotes a video signal value (in the present example, the maximum video signal value from the maximum-value calculation unit 111), and L denotes relative luminance. Normally, $\alpha$ is set to 0.0, and $\gamma$ is set to 2.2. However, $\alpha$ and $\gamma$ are not limited to these values. Furthermore, the hardware configuration of the gamma conversion unit 112 may be such that the gamma conversion unit 112 may use a multiplier or the like to actually perform the operation in Expression (1) or utilize a lookup table (LUT) that allows the relative luminance L corresponding to the video signal value S to be searched for. The gamma conversion unit 112 inputs the relative luminance L to the light source emission intensity calculation unit 120 as an emission intensity to be assigned to the corresponding small-area.

Figure 5:
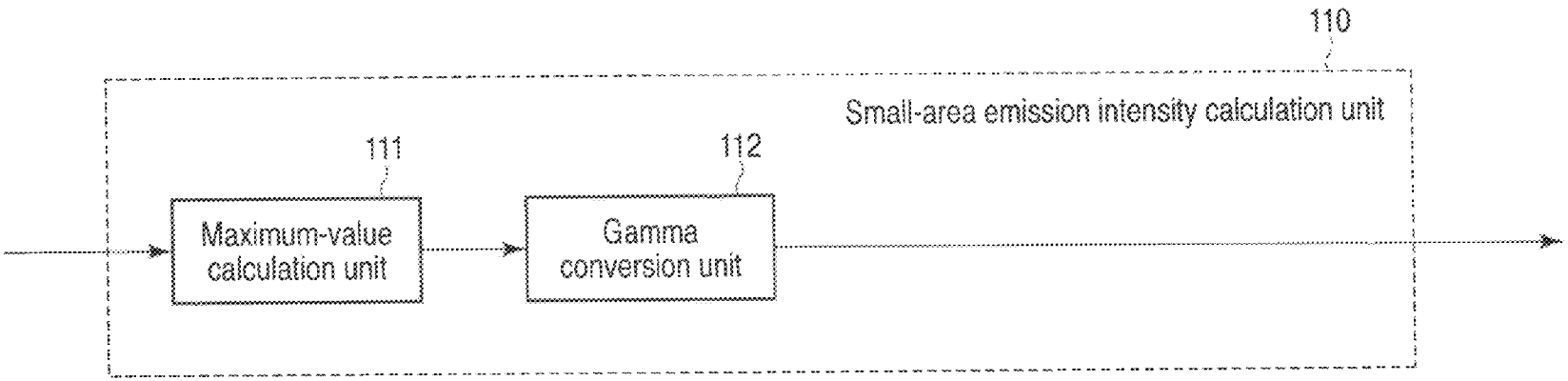
FIG. 5 is a diagram showing an example of a small-area emission intensity calculation unit in FIG. 3.

The small-area emission intensity calculation unit 110 in FIG. 5 calculates the emission intensity to each small-area based on the maximum video signal value in the calculation area corresponding to the small-area.

The small-area emission intensity calculation unit 110 may have any configuration capable of calculating the emission intensity to be assigned to each small-area. For example, the small-area emission intensity calculation unit 110 may be replaced with a small-area emission intensity calculation unit 210 shown in FIG. 6 or a small-area emission intensity calculation unit 310 shown in FIG. 7.

Figure 6:
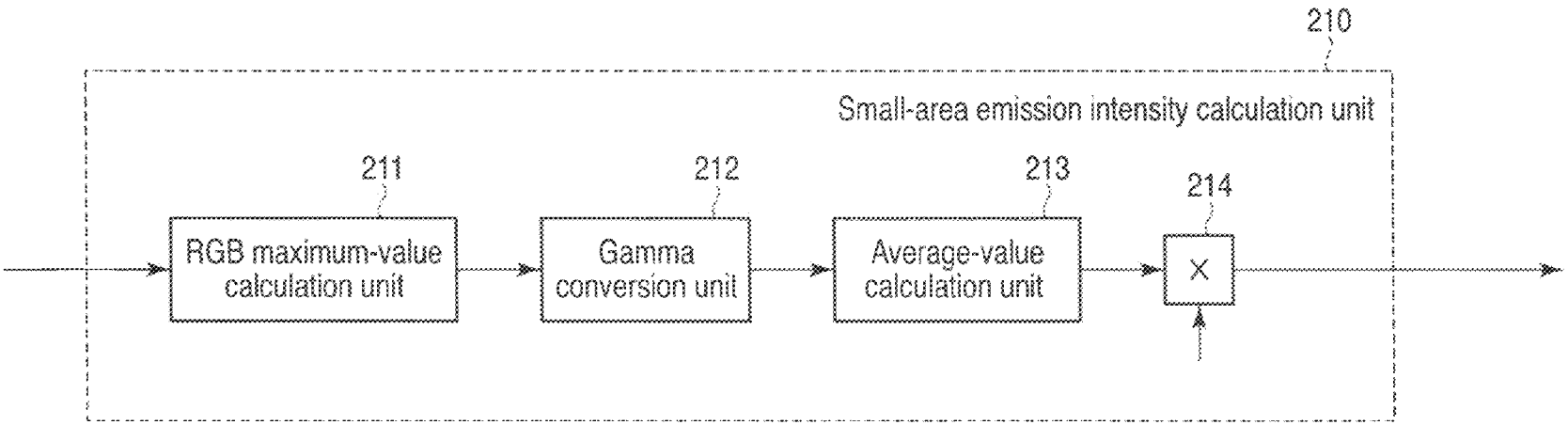
FIG. 6 is a diagram showing an example of the small-area emission intensity calculation unit in FIG. 3.

The small-area emission intensity calculation unit 210 in FIG. 6 includes an RGB maximum-value calculation unit 211, a gamma conversion unit 212, an average value calculation unit 213, and a multiplication unit 214.

The RGB maximum-value calculation unit 211 calculates the maximum value (hereinafter simply referred to as the RGB maximum value) of an RGB signal value (R (red) signal value, G (green) signal value, and B (blue) signal value) for each pixel of an input video signal. That is, the maximum-value calculation unit 111 calculates the RGB maximum value for each of the pixels included in the calculation area. The maximum-value calculation unit 111 inputs the RGB maximum value for each of the pixels included in the calculation area, to the gamma conversion unit 212.

The gamma conversion unit 212 carries out gamma conversion on each RGB maximum value from the RGB maximum-value calculations unit 211. Specifically, in the gamma conversion, the gamma conversion unit 212 converts each RGB maximum value into a relative luminance. For example, the gamma conversion unit 212 carries out the same gamma conversion as or a gamma conversion similar to that carried out by the above-described gamma conversion unit 112. The gamma conversion unit 212 inputs each RGB maximum value converted into a relative luminance (hereinafter simply referred to as a maximum RGB luminance) to an average value calculation unit 213.

The average value calculation unit 213 calculates the average value (hereinafter simply referred to as the average relative luminance) of the maximum RGB luminances from the gamma conversion unit 212. For example, the average value calculation unit 213 calculates the average relative luminance by dividing the sum of the maximum RGB luminances by the number of pixels included in the calculation area. The average value calculation unit 213 inputs the average relative luminance to the multiplication unit 214.

The multiplication unit 214 multiplies the average relative luminance by a predetermined constant to calculate an emission intensity to be assigned to the corresponding small-area. The hardware configuration of the multiplier unit 214 may be such that the multiplier unit 214 may use a multiplier or the like to actually carry out a multiplication by the constant or utilize LUT allowing the emission intensity corresponding to the average relative luminance to be searched for. The multiplication unit 214 inputs the emission intensity to be assigned to each small-area, to the light source emission intensity calculation unit 120.

The small-area emission intensity calculation unit 210 in FIG. 6 calculates an emission intensity to be assigned to each small-area, based on the average value of the maximum RGB luminances for each of pixels in the calculation area corresponding to the small-area.

Figure 7:
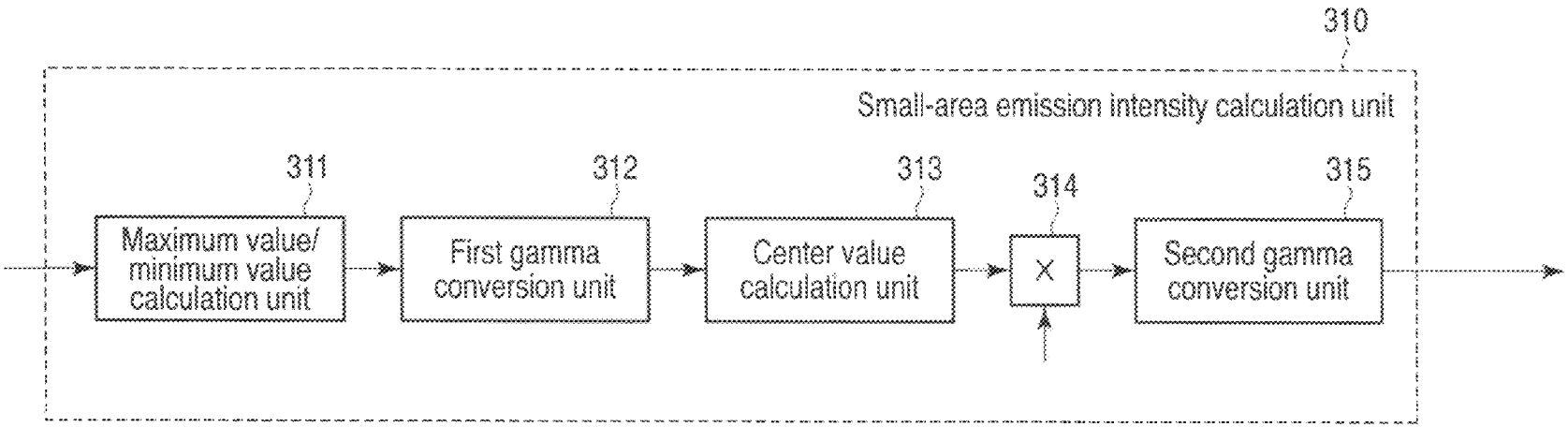
FIG. 7 is a diagram showing an example of the small-area emission intensity calculation unit in FIG. 3.

The small-area emission intensity calculation unit 310 in FIG. 7 includes a maximum value/minimum value calculation unit 311, a first gamma conversion unit 312, a center value calculation unit 313, a multiplication unit 314, and a second gamma conversion unit 315.

The maximum value/minimum value calculation unit 311 calculates the maximum value and minimum value for the video signals in the calculation area corresponding to each small-area. That is, the maximum value/minimum value calculation unit 311 calculates the maximum video signal value and minimum video signal value in the calculation area. The maximum value/minimum value calculation unit 311 inputs the maximum video signal value and minimum video signal value in the calculation area, to the first gamma conversion unit 312.

The first gamma conversion unit 312 carries out gamma conversion on each of the maximum video signal value and minimum video signal value from the maximum value/minimum value calculation unit 311. Specifically, in the gamma conversion, the first gamma conversion unit 312 converts a video signal value into a relative lightness. For example, the first gamma conversion unit 312 carries out gamma conversion in accordance with Equation (1) with $\alpha$ set to 0.0 and $\gamma$ set to 2.2/3.0. The first gamma conversion unit 312 inputs the relative lightness resulting from the conversion of the maximum video signal value (this lightness is hereinafter simply referred to as the maximum lightness) and the relative lightness resulting from the conversion of the minimum video signal value (this lightness is hereinafter simply referred to as the minimum lightness), to the center value calculation unit 313.

The center value calculation unit 313 calculates the center value between the maximum lightness and minimum lightness from the first gamma conversion unit 312. The center value corresponds to the center value of the lightness in the calculation area. For example, the center value calculation unit 313 calculates the average value of the maximum lightness and minimum lightness to be a center value. The center value calculation unit 313 inputs the center value to the multiplication unit 314.

The multiplication unit 314 multiplies the center value from the center value calculation unit 313 by a predetermined constant. The multiplication unit 314 inputs the multiplication result (hereinafter simply referred to as a lightness modulation rate) to the second gamma conversion unit 315.

The second gamma conversion unit 35 carries out gamma conversion on the lightness modulation rate from the multiplication unit 314. Specifically, in the gamma conversion, the second gamma conversion unit 315 converts the lightness modulation rate into a relative luminance. For example, the second gamma conversion unit 315 carries out gamma conversion in accordance with:

$$L=(1-\alpha)\cdot L^{*\gamma}+\alpha \quad (2)$$

In Expression (2), $\alpha$ and $\gamma$ denote constants, L denotes a relative luminance, and L* denotes the lightness modulation rate. Normally, $\alpha$ is set to 0.0, and $\gamma$ is set to 3.0. However, $\alpha$ and $\gamma$ are not limited to these values. Furthermore, the hardware configuration of the second gamma conversion unit 315 may be such that the gamma conversion unit 315 may use a multiplier or the like to actually perform the operation in Expression (2) or utilize LUT that allows the relative luminance L corresponding to the lightness modulation rate L* to be searched for. The second gamma conversion unit 315 inputs the relative luminance L to the light source emission intensity calculation unit 120 as an emission intensity to be assigned to the corresponding small-area.

The small-area emission intensity calculation unit 310 in FIG. 7 calculates the emission intensity to be assigned to each small-area, based on the center value between the maximum and minimum values of lightness in the calculation area corresponding to the small-area.

Based on the positional relationship between each illumination area and nearby small-areas, the light source emission intensity calculation unit 120 combines emission intensities assigned to the respective small-areas to calculate the emission intensity to be assigned to each of the light sources 51. The light source emission intensity calculation unit 120 inputs the emission intensity to be assigned to each light source 51, to the signal correction unit 10 and the backlight control unit 40.

For example, the light source emission intensity calculation unit 120 may calculate the emission intensity of each of the light sources 51 as follows. Based on the positional relationship between each illumination area and nearby small-areas (the relationship is, for example, the distance from the center of the illumination area), the light source emission intensity calculation unit 120 assigns a weight coefficient to the emission intensity of each of the small-areas, and then calculates a weighted average.

Figure 8:
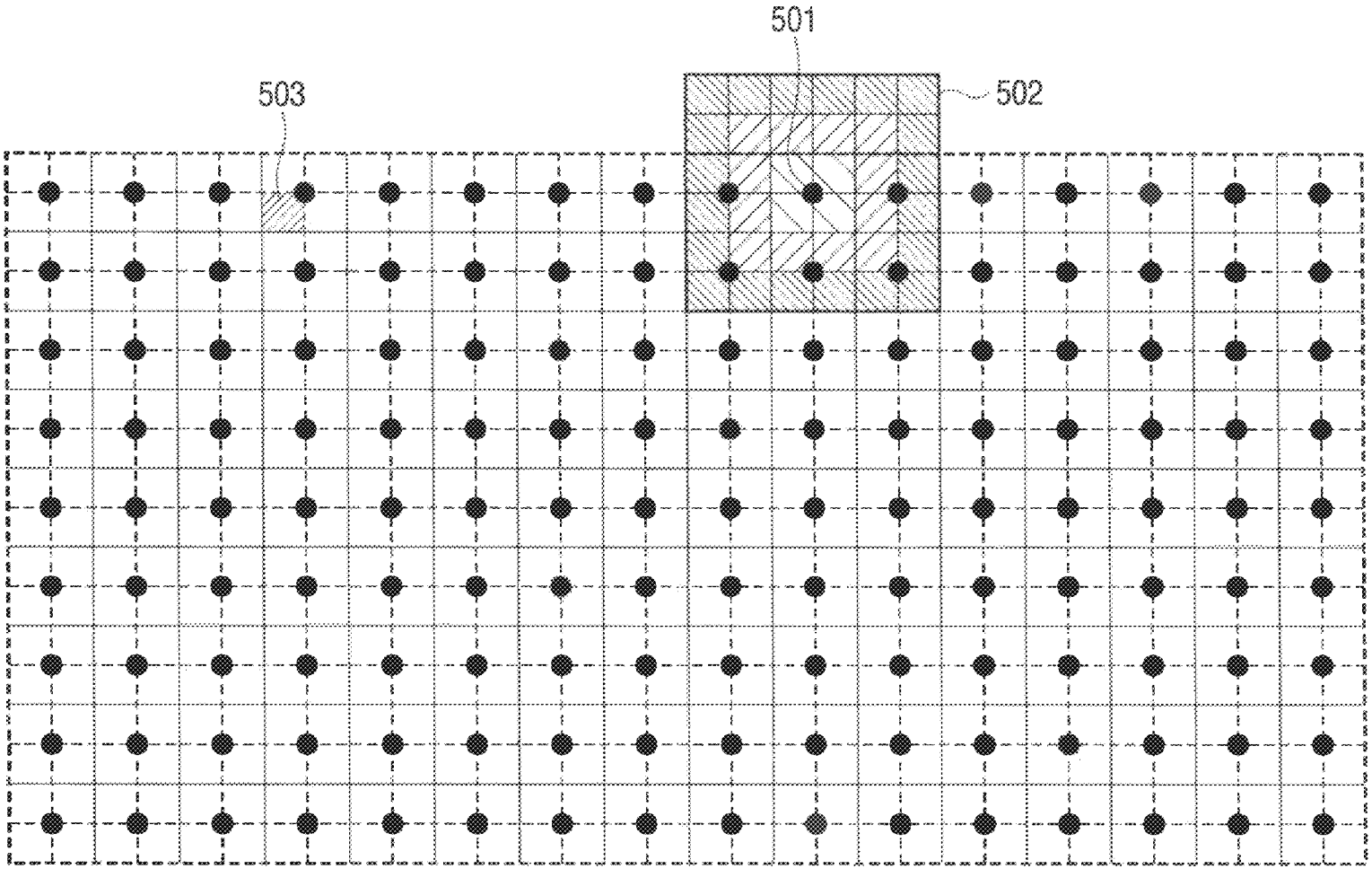
FIG. 8 is a diagram illustrating an aspect in which a light source emission intensity calculation unit in FIG. 3 assigns weight coefficients.

FIG. 8 shows an example of an aspect of assignment of weight coefficients. The light source emission intensity calculation unit 120 assigns a weight coefficient to each of the emission intensities of the small-areas included in the range 502 located close to the center 501. The light source emission intensity calculation unit 120 then calculates the emission intensity of the light source 51 corresponding to the illumination area for the center 501, to be a weighted average. In FIG. 8, the small-areas refer to areas 503 into which the liquid crystal panel is divided by dashed lines. Here, the weight coefficient may vary among the small-areas included in the range 502.

Figure 9:
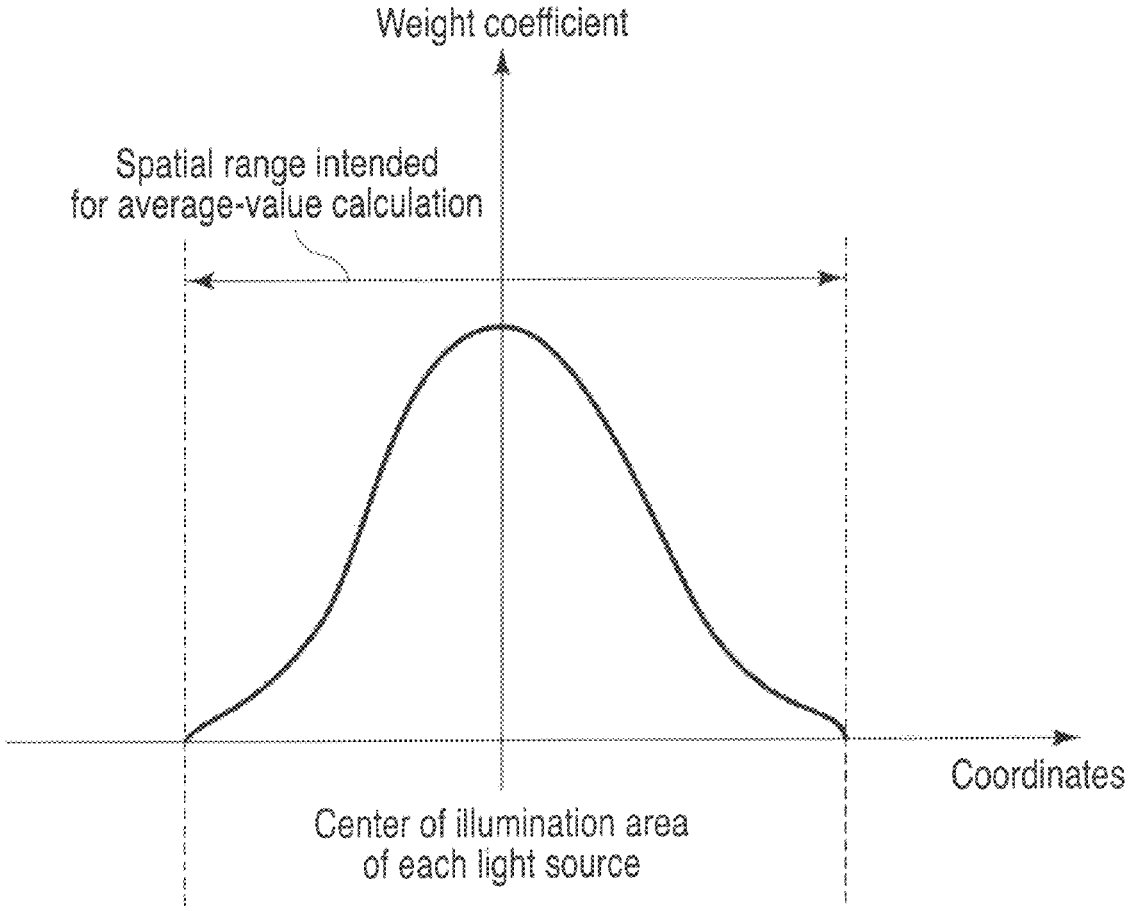
FIG. 9 is a graph showing the spatial distribution of weight coefficients assigned by the light source emission intensity calculation unit in FIG. 3.

For example, as shown in FIG. 9, the preferable distribution of weight coefficients is such that the weight coefficient decreases gradually and consistently with the distance from the center of the illumination area. Furthermore, when the distribution of weight coefficients is symmetrical with respect to the center of the illumination area, a same weight coefficient multiplication can be applied for some different small-areas. This enables a reduction in the calculation cost for the weighted average described below. Furthermore, a low pass filter coefficient with low pass frequency characteristics, for example, a Gaussian filter, is suitable as the weight coefficient. The use of a low pass filter coefficient as the weight coefficient allows the emission intensity of the light source 51 to be more smoothly varied. This enables suppression of a rapid variation in luminance which is likely to occur when the bright point or the like moves across adjacent illumination areas.

The light source emission intensity calculation unit 120 calculates the weighted average corresponding to the emission intensity of each light source 51, for example, in accordance with:

$$L_C(x, y) = \frac{\sum_{\Delta y=-r_y}^{r_y} \sum_{\Delta x=-r_x}^{r_x} \{w(\Delta x, \Delta y) \cdot L_F(x+\Delta x, y+\Delta y)\}}{\sum_{\Delta y=-r_y}^{r_y} \sum_{\Delta x=-r_x}^{r_x} w(\Delta x, \Delta y)} \quad (3)$$

In Expression (3), Lc(x, y) denotes the emission intensity of the light source 51 corresponding to the coordinates (x, y). w(Δx, Δy) denotes the distribution value of the weight coefficient at the relative coordinates (Δx, Δy). $L_F$(x+Δx, y+Δy) denotes the emission intensity of the small-area corresponding to the coordinates (x+Δx, y+Δy). rx and ry denote the radius of a weight coefficient assignment table (in the present example, the rectangular range is specified, but the embodiments are not limited to this aspect).

Furthermore, the light source emission intensity calculation unit 120 may use an alternative method to calculate the emission intensity of each light source 51. For example, the light source emission intensity calculation unit 120 utilizes a weight coefficient as a spatial filter coefficient to carry out a spatial filter process on the emission intensity of each small-area. Then, the light source emission intensity calculation unit 120 carries out an interpolation process (for example, a linear interpolation process) based on the emission intensity of each small-area subjected to the spatial filter process and the positional relationship between the each small-area and the corresponding illumination area. The light source emission intensity calculation unit 120 thus calculates the emission intensity of each light source 51. A calculation technique based on such an interpolation process produces results similar to the above-described calculation technique based on the weighted average, simply by assigning a given weight coefficient to the emission intensity of each small-area. For example, if the above-described calculation technique based on the weighted average is applied, the weight coefficient assigned to the emission intensity of a certain small-area may vary among illumination areas. However, if the calculation technique based on the interpolation process is applied, a weight coefficient common to illumination areas can be assigned to the emission intensity of each small-area.

The signal correction unit 10 corrects the light transmittance (luminance) of each pixel in an input video signal based on the emission intensity of each light source 51 from the emission intensity determination unit 100. Specifically, the signal correction unit 10 corrects the light transmittance of a video signal in terms of pixels forming the display area of the liquid crystal panel 30. The signal correction unit 10 inputs a video signal reflecting a correction for the light transmittance (the signal is hereinafter referred to as a corrected video signal), to the liquid crystal control unit 20.

Figure 11:
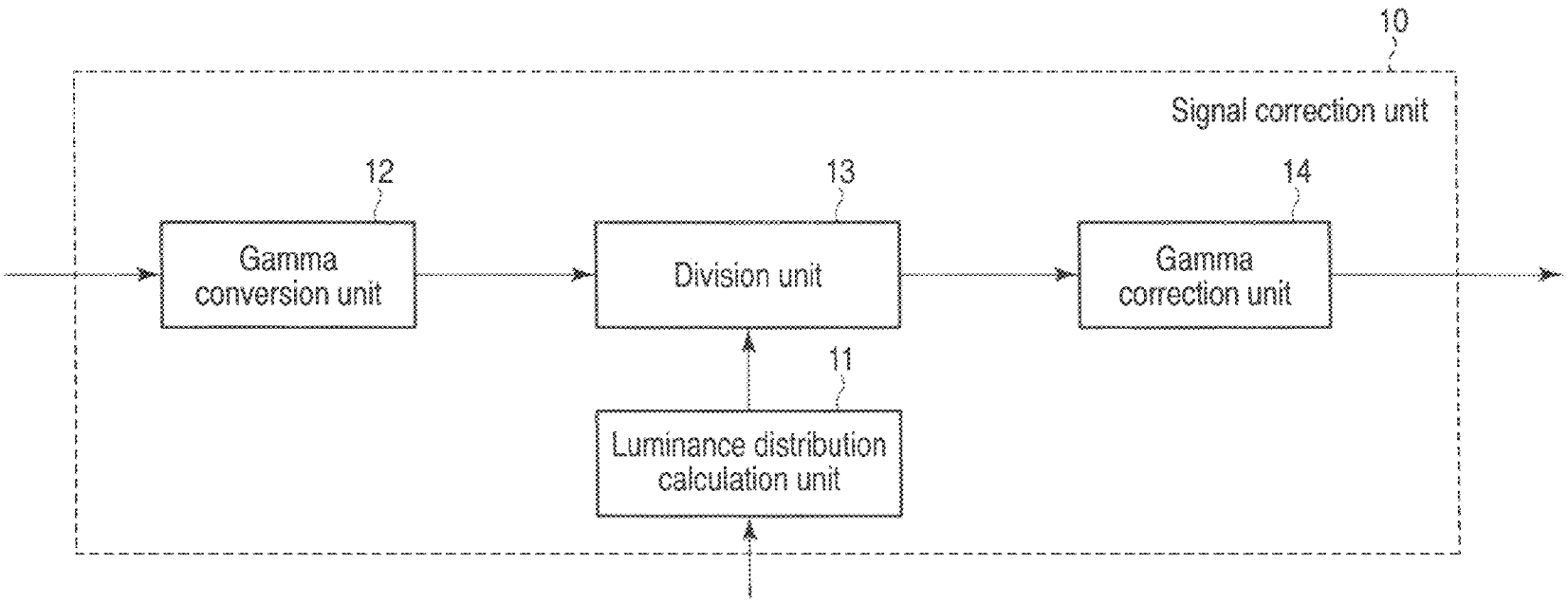
FIG. 11 is a diagram showing a signal correction unit in FIG. 1.

An example of the signal correction unit 10 will be described with reference to FIG. 11. The signal correction unit 10 in FIG. 11 includes a luminance distribution calculation unit 11, a gamma conversion unit 12, a division unit 13, and a gamma correction unit 14.

The luminance distribution calculation unit 11 calculates a predicted value for the luminance distribution in the display area of the liquid crystal panel 30 based on the emission intensity of each light source 51 from the emission intensity determination unit 100. That is, the luminance distribution calculation unit 11 calculates the luminance distribution in the display area of the liquid crystal panel 30 resulting from lighting of each light source 51 in accordance with the emission intensity determined by the emission intensity determination unit 100. The luminance distribution calculation unit 11 inputs the calculated luminance distribution to the division unit 13. An example of a technique for calculating the luminance distribution will be described below.

Figure 12:
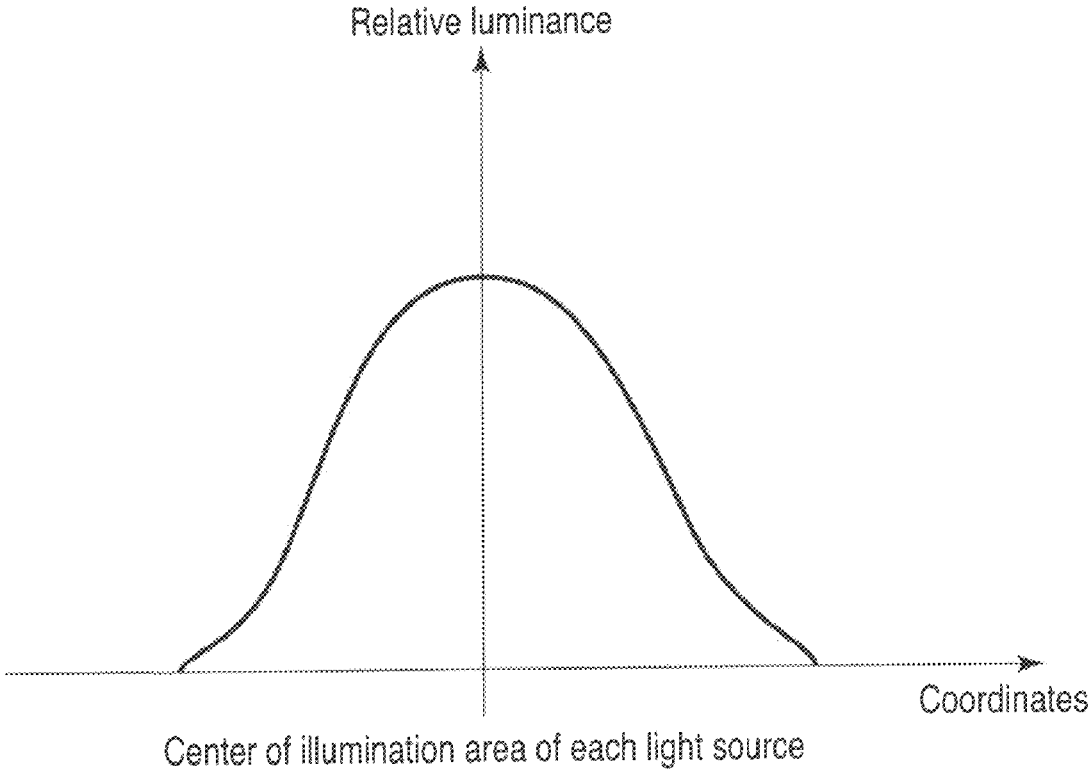
FIG. 12 is a graph showing the spatial distribution of luminance in an illumination area illuminated by a light source included in the backlight in FIG. 1.

The emission distribution of each light source 51 depends on the actual hardware configuration. The intensity distribution of illumination light incident on the rear surface of the liquid crystal panel 30 as a result of lighting of each light source 51 is based on the emission distribution of each light source 51. The illumination light intensity distribution is hereinafter sometimes referred to as backlight luminance or the luminance of the light source 51. FIG. 12 shows an example of the luminance distribution of the single light source 51. The luminance distribution is symmetric with respect to the center of the illumination area corresponding to the light source 51. The luminance decreases with increasing distance from the center of the illumination area. The backlight luminance based on illumination light from the single light source is expressed, for example, by:

$$L_{BL}(x'_n,y'_n)=L_{SET,n}\cdot L_{P,n}(x'_n,y'_n) \tag{4}$$

In Expression (4), $L_{SET,n}$ denotes the emission intensity of the nth light source (n is any integer and is an expedient number that uniquely identifies the light source 51 (in the description below, any one of consecutive integers from 1 to the total number of light sources)). $L_{P,n}(x_n', y_n')$ denotes the luminance distribution value at the coordinates $(x_n', y_n')$ relative to the center of the illumination area corresponding to the nth light source. $L_{BL}(x_n', y_n')$ denotes the backlight luminance at the relative coordinates $(x_n', y_n')$ based on illumination light from the nth light source. The luminance distribution value at the relative coordinates may be calculated by substituting relative coordinates (or distance) into any function approximating the luminance distribution of the light source 51. Alternatively, the luminance distribution value at the relative coordinates may be derived utilizing LUT allowing the luminance distribution value corresponding to the relative coordinates (or distance) to be searched for.

In actuality, illumination light beams from light sources 51 may overlap one another. Thus, the backlight luminance $L_{BL}$ (x, y) at the coordinates (x, y) in the display area of the liquid crystal panel 30 is expressed by:

$$L_{BL}(x, y) = \sum_{n=1}^{N} \{L_{SET,n} \cdot L_{P,n}(x - x_{0,n}, y - y_{0,n})\} \tag{5}$$

In Expression (5), the coordinates $(x_{0,n}, y_{0,n})$ are present on the display area of the liquid crystal panel 30 at the central position of the illumination area corresponding to the nth light source. In Expression (5), all the light sources 51 are intended for the calculation of the backlight luminance. However, the number of light sources 51 intended for the calculation of the backlight luminance may be reduced with the luminance distribution of the light source 51 taken into account. For example, the light source 51 corresponding to an illumination area located far away from the coordinates (x, y) may be excluded from the calculation of the backlight luminance at the coordinates (x, y).

The gamma conversion unit 12 carries out gamma conversion on an input video signal (RGB format). Specifically, in the gamma conversion, the gamma conversion unit 12 converts an R signal value, a G signal value, and a B signal value contained in the video signal into light transmittances. For example, if the variance range of the video signal value is at least 0 and at most 255 (8 bit value), the gamma conversion unit 12 carries out gamma conversion in accordance with:

$$\begin{cases} T_R = (1-\alpha_3)\left(\dfrac{S_R}{255}\right)^{\gamma_3} + \alpha_3 \\ T_G = (1-\alpha_3)\left(\dfrac{S_G}{255}\right)^{\gamma_3} + \alpha_3 \\ T_B = (1-\alpha_3)\left(\dfrac{S_B}{255}\right)^{\gamma_3} + \alpha_3 \end{cases} \tag{6}$$

In Expression (6), $\alpha_3$ and $\gamma_3$ denote constants, and $S_R$, $S_G$, and $S_B$ denote the R signal value, G signal value, and B signal value contained in the video signal. $T_R$, $T_G$, and $T_B$ denote the light transmittances of the colors (R, G, and B). Normally, $\alpha_3$ is set to 0.0, and $\gamma_3$ is set to 2.2. However, $\alpha$ and $\gamma$ are not limited to these values. The gamma conversion unit 12 inputs the light transmittance of each pixel to the division unit 13.

The division unit 13 divides the light transmittance of each of the pixels in the display area of the liquid crystal panel 30 by the luminance distribution value of the pixel. The division unit 13 inputs the light transmittance, a division result, (hereinafter simply referred to as the corrected light transmittance) to the gamma correction unit 14. The division unit 13 may utilize LUT enabling a corrected light transmittance to be searched for based on the corresponding light transmittance and luminance distribution value.

The gamma correction unit 14 carries out gamma correction on the corrected light transmittance from the division unit 13. Specifically, in the gamma correction, the gamma correction unit 14 converts the light transmittance back into the video signal value (RGB format). For example, if the variance range of the video signal value is at least 0 and at most 255 (8 bit value), the gamma correction unit 14 carries out gamma correction in accordance with:

$$\begin{cases} S'_R = 255\times\left(\dfrac{T'_R-\alpha_4}{1-\alpha_4}\right)^{\frac{1}{\gamma_4}} \\ S'_G = 255\times\left(\dfrac{T'_G-\alpha_4}{1-\alpha_4}\right)^{\frac{1}{\gamma_4}} \\ S'_B = 255\times\left(\dfrac{T'_B-\alpha_4}{1-\alpha_4}\right)^{\frac{1}{\gamma_4}} \end{cases} \tag{7}$$

In Expression (7), $\alpha_4$ and $\gamma_4$ denote constants, and $T_R'$, $T_G'$, and $T_B'$ denote the corrected light transmittances of the respective colors (R, G, and B). $S_R'$, $S_G'$, and $S_B'$ denote the R signal value, a G signal value, and a B signal value, respectively. The gamma correction unit 14 inputs $S_R'$, $S_G'$, and $S_B'$ to the liquid crystal control unit 20 as corrected video signals. Normally, to allow videos faithful to input video signals to be displayed, $\alpha_4$ is set to the minimum light transmittance of the liquid crystal panel 30 and $\gamma_4$ is set to the gamma value of the liquid crystal panel 30. However, $\alpha_4$ and $\gamma_4$ are not limited to these values. Furthermore, the gamma correction carried out by the gamma correction unit 14 need not be a conversion scheme based on Expression (7) but may be replaced with an existing or future conversion scheme. For example, the gamma correction unit 14 may carry out, as gamma correction, reverse conversion corresponding to a gamma conversion table for the liquid crystal panel 30. Furthermore, the hardware configuration of the gamma correction unit 14 may be such that the gamma correction unit 14 may implement gamma correction via an operation performed by a multiplier or the like or utilizing an appropriate LUT.

The liquid crystal control unit 20 controls the liquid crystal panel 30 in accordance with the corrected video signal from the signal correction unit 10. Specifically, the liquid control unit 20 controls the light transmittance of the liquid crystal panel 30 in terms of pixels in order to allow the video corresponding to the corrected video signal to be displayed in the display area of the liquid crystal panel 30.

The liquid crystal panel 30 includes a display area formed of pixels and in which videos are displayed. Specifically, the liquid crystal panel 30 modulates illumination light from the backlight 50 at a light transmittance controlled by the liquid crystal control unit 20 to display the desired video.

An example of the liquid crystal control unit 20 and the liquid crystal panel 30 will be described below with reference to FIG. 13.

Figure 13:
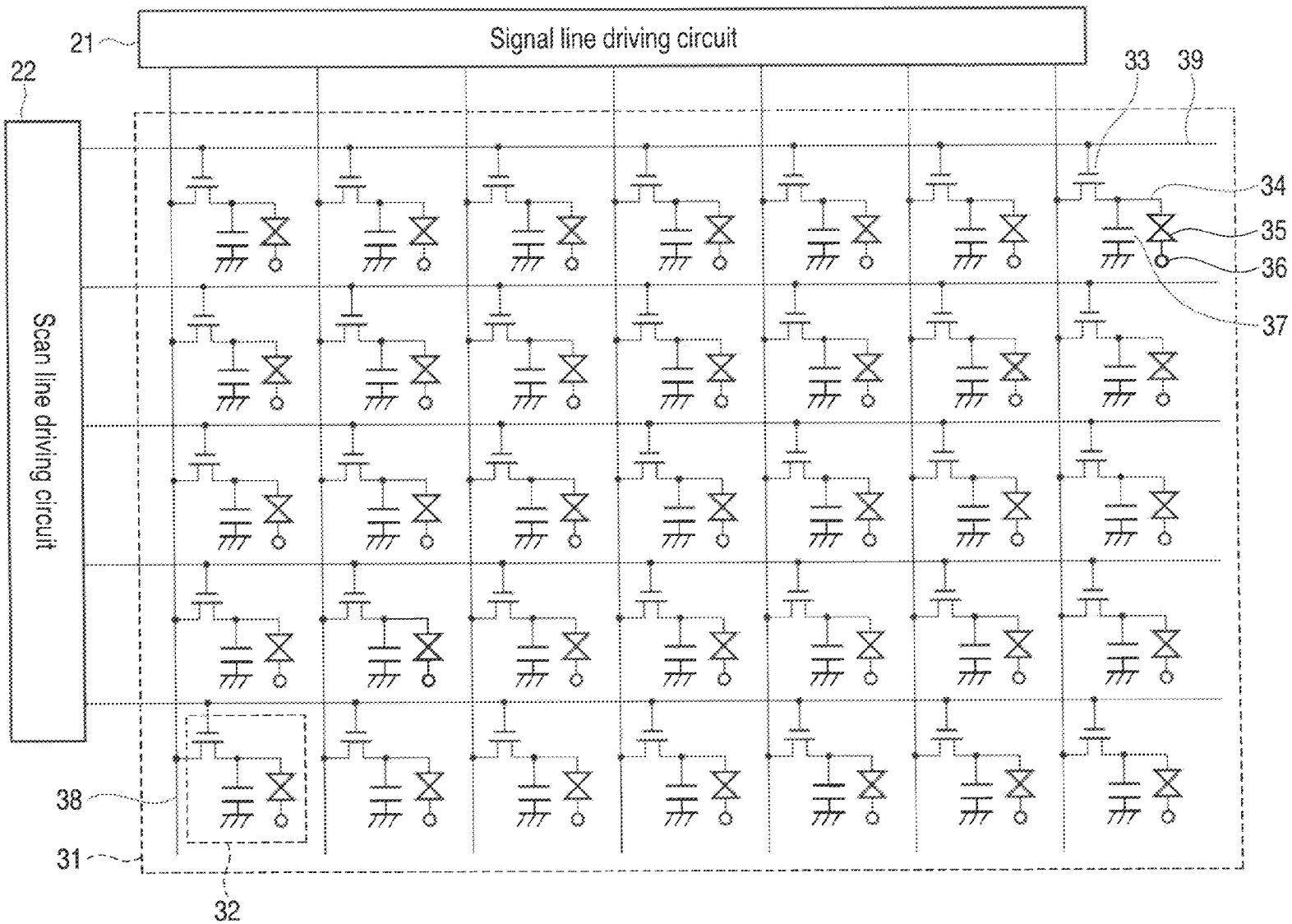
FIG. 13 is a diagram showing a liquid crystal panel and a liquid crystal control unit in FIG. 1.

In the example shown in FIG. 13, the liquid crystal panel 30 is of what is called an active matrix type. The liquid crystal panel 30 includes an array substrate 31. Signal lines 38 and scan lines 39 are arranged on the array substrate 31 via an insulating film (not shown in the drawings); the signal lines 38 are arranged in the vertical direction, and the scan lines are arranged in the horizontal direction so as to cross the signal lines 38. Each of cross areas of signal lines 38 and scan lines 39 forms a pixel 32. The pixel 32 includes a switch element 33 formed of a thin film transistor (TFT), a pixel electrode 34, a liquid crystal layer 35, an opposite electrode 36, and a auxiliary capacitor 37. The opposite electrodes 36 are common in all the pixels 32.

The switch element 33 is controlled by the liquid crystal control unit 20 to allow video to be written. A gate terminal of the switch element 33 is connected to one of the scan lines 39. A source terminal of the switch element 33 is connected to one of the signal lines 38. To which of the scan lines 39 the gate terminal of the switch element 33 is connected and to which of the signal lines 38 the source terminal of the switch element 33 is connected depend on the coordinates (vertical position and horizontal position) of the pixel 32 including the switch element 33. Furthermore, a drain terminal of the switch element 33 is connected in parallel with the pixel electrode 34 in the pixel 32 including the switch element and with one end of the auxiliary capacitor 37. The other end of the auxiliary capacitor 37 is grounded.

Each pixel electrode 34 is formed on the array substrate 31. On the other hand, each opposite electrode 36 is located electrically opposite the pixel electrode 34 and formed on an opposite substrate (not shown in the drawings) different from the array substrate 31. An opposite voltage generation circuit (not shown in the drawings) applies a predetermined opposite voltage to each opposite electrode 36. A liquid crystal layer 35 is held between the pixel electrode 34 and the opposite electrode 36 and sealed by a seal material (not shown in the drawings) provided around the array substrate 31 and the opposite substrate. Any liquid crystal material may be used as the liquid crystal layer 35. For example, ferroelectric liquid crystal or a liquid crystal in an OCB (Optically Compensated Bend) mode is preferred.

In the example in FIG. 13, the liquid crystal control unit 20 includes a signal line driving circuit 21 to which one end of each signal line 38 is connected and a scan line driving circuit 22 to which one end of each scan line 39 is connected. The signal line driving circuit 21 controls a voltage to be applied to the source terminal of each switch element 33 via the corresponding signal line 38. Furthermore, the scan line driving circuit 22 controls a voltage to be applied to the gate terminal of each switch element 33 via the corresponding scan line 39.

The signal line driving circuit 21 includes, for example, an analog switch, a shift register, a sample hold circuit, and a video bus. The signal line driving circuit 21 receives horizontal start signals and horizontal clock signals from a display ratio control unit (not shown in the drawings) as control signals, also receives video signals (in the video display apparatus according to the present embodiment, corrected video signals).

The scan line driving circuit 22 includes, for example, a shift register and a buffer circuit. The scan line driving circuit 22 receives vertical start signals and vertical clock signals from the display ratio control unit as control signals. The scan line driving circuit 22 outputs row select signals to the respective scan lines 39 based on the control signals.

As described above, the video display apparatus according to the present embodiment determines the emission intensities of the light sources included in the backlight, based on the emission intensities assigned to the small-areas into which the display area is divided and each of which is smaller than the illumination area corresponding to each light source. Thus, the video display apparatus according to the present embodiment allows the emission intensity of each light source to be varied in stages with a variation in video signal in terms of the small-areas each smaller than the illumination area reflected. Hence, a possible unnatural variation in luminance in each illumination area can be inhibited.

Figure 10A:
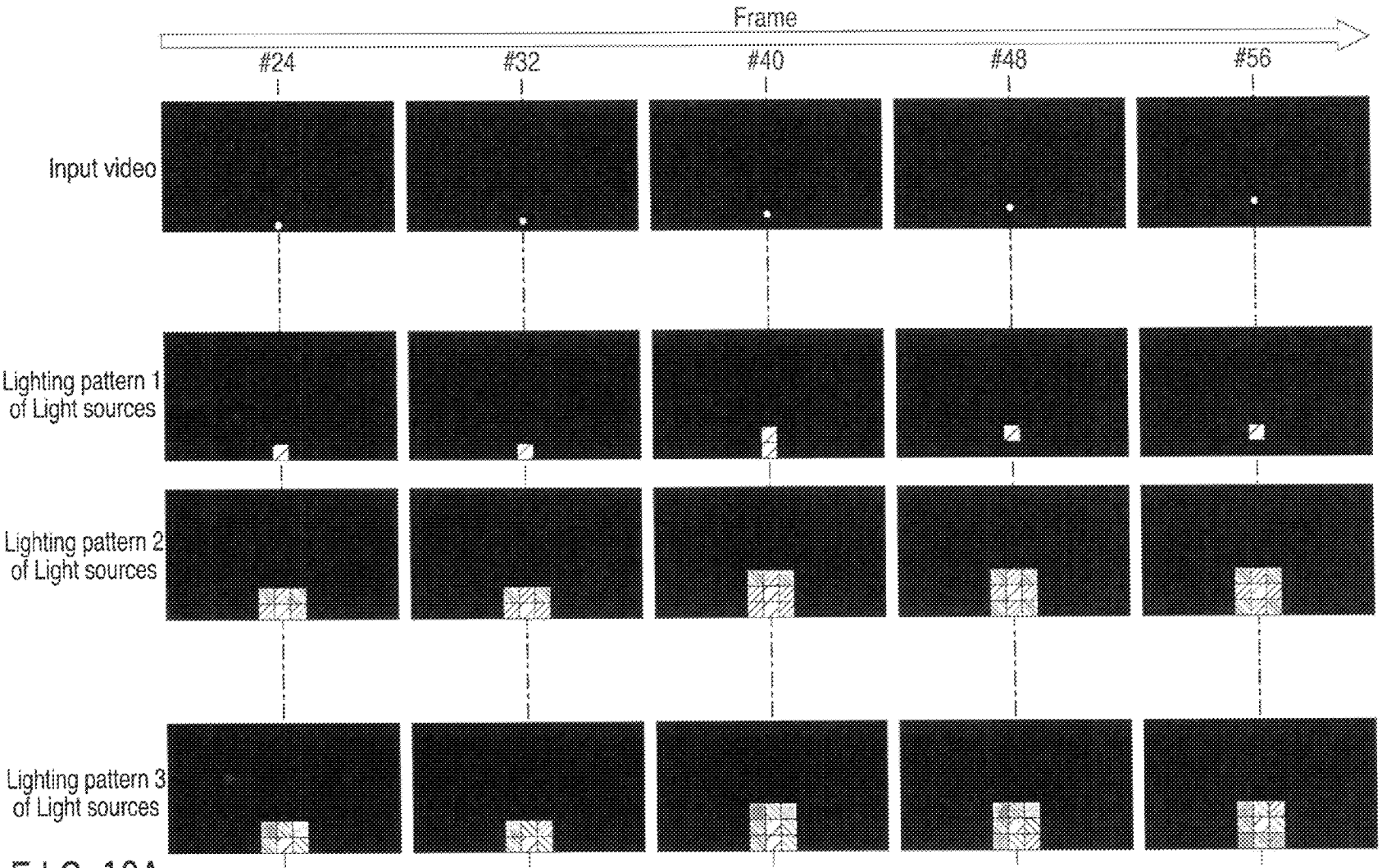
FIG. 10A is a diagram illustrating, in a supplementary manner, the effects of processing performed by the emission intensity determination unit in FIG. 3.
Figure 10B:
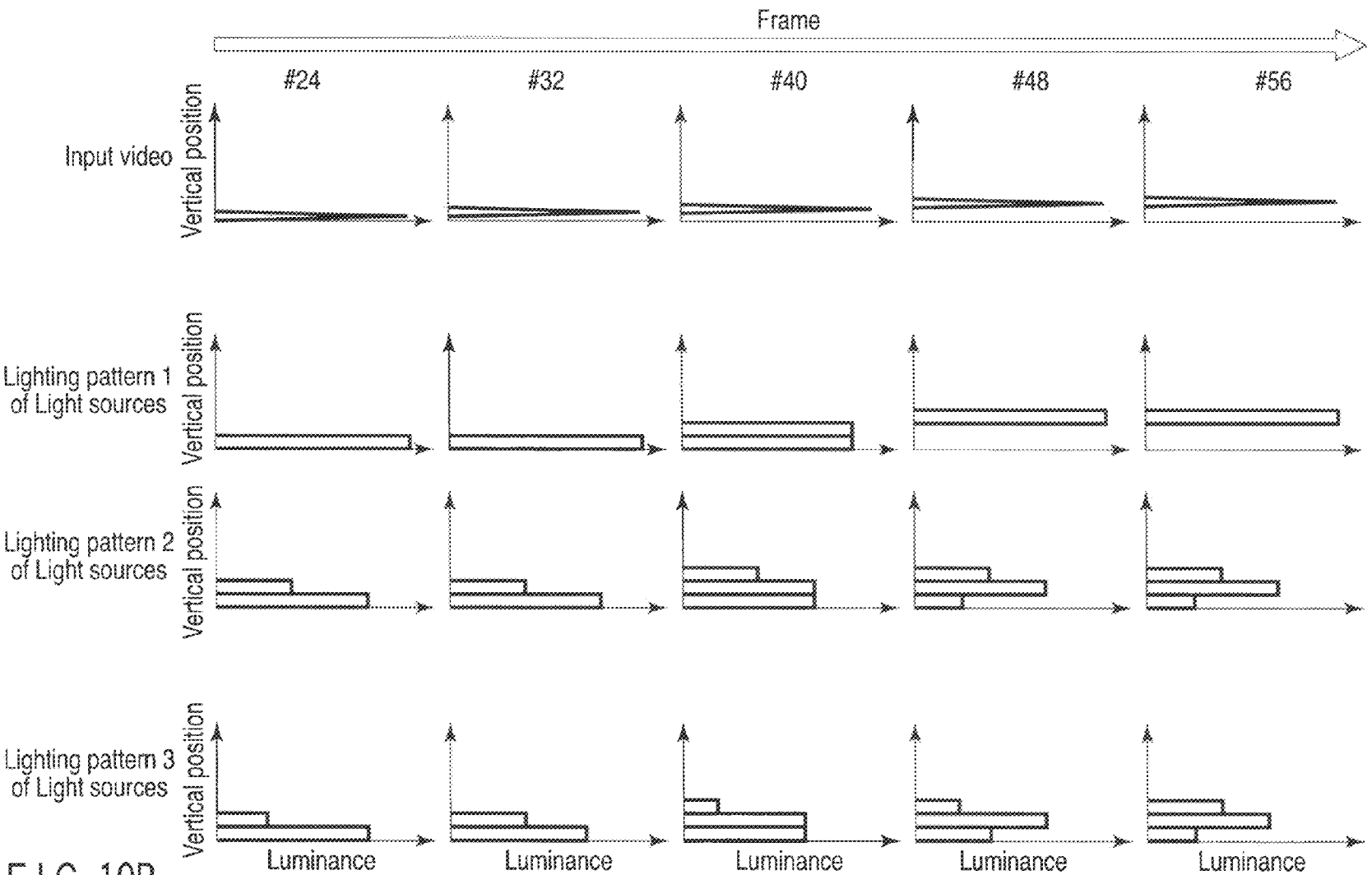
FIG. 10B is a diagram showing the luminance distributions in input videos and lighting patterns, in a cross section of each trajectory of fireworks in FIG. 10A.

With reference to FIG. 10A and FIG. 10B, supplementary description will be given of the effects of a process of determining the emission intensity of each light source 51 which process is carried out by the video display apparatus according to the present embodiment. FIG. 10A conceptually shows the lighting patterns of light sources obtained when the emission intensity of each light source is determined by three types of techniques based on input video signals for five frames (frames #24, #32, #40, #48, #56). In FIG. 10A, the input video shows fireworks moving generally in the vertical direction. FIG. 10B shows the luminance distributions in the input videos and lighting patterns in FIG. 10A, in a cross section of trajectory of the fireworks.

In a lighting pattern 1, the emission intensity of each light source is determined based on video signals contained in the areas (corresponding to the above-described illumination areas) into which the display area of the liquid crystal panel is virtually divided in association with the spatial location of the light source. As is apparent from FIG. 10A and FIG. 10B, the lighting pattern 1 cannot sufficiently follow movement of the fireworks. Specifically, regardless of the difference in the position of the fireworks, the luminance distribution of the trajectory cross section matches between frame #24 and frame #32. This also applies to frame #48 and frame #56. Furthermore, a rapid variation in luminance is observed between frame #32 and frame #40 and between frame #40 and frame #48. Thus, if the input video is displayed based on the lighting pattern 1, the observer perceives an unnatural (discontinuous) variation in luminance.

In a lighting pattern 2, the emission intensity of each light source is obtained by carrying out the low-pass spatial filter process on the emission intensity of the light source obtained by a technique similar to that for the lighting pattern 1. As is apparent from FIG. 10A and FIG. 10B, compared to the lighting pattern 1, the lighting pattern 2 involves a reduced spatial gap (unevenness) in the luminance distribution in each frame. That is, compared to the lighting pattern 1, the lighting pattern 2 serves to make each single illumination area in each frame unlikely to exhibit a much higher luminance than surrounding illumination areas. However, the lighting pattern 2 fails to solve the fundamental problem with the lighting pattern 1, that is, the failure to sufficiently follow the movement of the fireworks (see frames #24 and #32 and frames #48 and #56).

In a lighting pattern 3, the emission intensity of each light source is determined by the emission intensity determination process carried out by the video display apparatus according to the present embodiment. As is apparent from FIG. 10A and FIG. 10B, the lighting pattern 3 follows the movement of the fireworks more appropriately than the lighting patterns 1 and 2. In the lighting pattern 3, the luminance of each illumination area varies smoothly (in stages) from frame #24 to frame #56. For example, in the lighting patterns 1 and 2, the lighting pattern of frame #32 is the same as that of frame #24. However, in the lighting pattern 3, the lighting pattern of frame #32 is intermediate between the lighting patterns of frames #24 and #40. Furthermore, in the lighting patterns 1 and 2, the lighting pattern of frame #48 is the same as that of frame #56. However, in the lighting pattern 3, the lighting pattern of frame #48 is intermediate between the lighting patterns of frames #40 and #56. That is, according to the lighting pattern 3, the luminance of each illumination area follows the movement of the fireworks to vary smoothly. This makes the observer unlikely to feel uncomfortable as a result of a variation in luminance.

Furthermore, the video display apparatus according to the present embodiment determines the emission intensity of each light source by carrying out the two-staged emission intensity calculation process. However, the first stage of the emission intensity calculation process may be omitted. That is, the emission intensity of each light source can be calculated by, for example, using weight coefficients to combine video signal values for pixels together for the calculation based on the positional relationship between each illumination area and the pixels, without using the concept of the small-areas and the corresponding calculation areas. However, this modification is not very preferable in terms of calculation costs. The second stage of the emission intensity calculation process requires a higher calculation cost than the first stage of the emission intensity calculation process. An increase in the number of calculation targets further increases the calculation cost. Hence, the first stage of emission intensity calculation process serves to compress the calculation targets of the second stage of emission intensity calculation process from the pixel unit to the small-area unit. That is, performance of the first stage of emission intensity calculation process enables a reduction in calculation cost required to determine the emission intensity of each light source.

Second Embodiment

The above-described first embodiment relating to the video display apparatus fails to refer to the emission colors (spectral characteristics) of the light sources 51 included in the backlight 50. If the light sources 51 emit a single color (for example, white), the above-described first embodiment is applicable without any change. On the other hand, if the light sources 51 emits colors (for example, R, G, and B (Red, Blue, and Green)), the above-described first embodiment is desirably partly modified as follows.

The emission intensity determination unit 100 desirably determines the emission intensity of each light source 51 for each emission color. For example, if the video signal is in the RGB format and the emission colors of the light sources 51 are R, G, and B, then the emission intensity determination unit 100 determines the emission intensity of a red light source based on an R signal value, determines the emission intensity of a green light source based on a G signal value, and determines the emission intensity of a blue light source based on a B signal value. Thus, if the constituent color of the video signal matches the emission color of the light source 51, the emission intensity determination unit 100 may determine the emission intensity of the light source 51 for each emission color based on the signal value for the color in the video signal. On the other hand, if the constituent color of the video signal fails to match the emission color of the light source 51, the emission intensity determination unit 100 converts the color indicated by the video signal into a combination of emission colors for each light source 51 and determine the emission intensity of the light source 51 for each emission color.

As described above, the video display apparatus according to the present embodiment determines the emission intensities of the light sources included in the backlight, per emission color, based on the emission intensities assigned to the small-areas into which the display area is divided and each of which is smaller than the illumination area corresponding to each light source. Thus, even if the light sources have emission colors, the video display apparatus according to the present embodiment allows a possible unnatural variation in luminance in each illumination area to be inhibited.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A video display apparatus comprising:

a liquid crystal panel configured to display a video on a display area including pixels;

light sources, each configured to be controlled respectively and to light in an illumination area into which the display area is virtually segmented according to an arrangement of the light sources;

a first calculation unit configured to calculate a second emission intensity corresponding to a small-area based on a video signal to be displayed in the small-area, wherein the small-area is a segment of the display area, a segmentation of the display area to obtain the small-area being finer than a segmentation of the display area to obtain the illumination area and being coarser than a segmentation of the display area to obtain the pixels;

a second calculation unit configured to calculate a first emission intensity, to control the light source, based on the second emission intensity; and a control unit configured to control the light source in accordance with the first emission intensity.

2. The apparatus according to claim 1, wherein the second calculation unit uses weight coefficients provided based on a positional relationship to calculate the first emission intensity from a weighted average of the second emission intensity.

3. The apparatus according to claim 2, wherein for each small-area the weight coefficient decreases with increasing spatial distance from a center of the illumination area.

4. The apparatus according to claim 3, wherein the first calculation unit calculates the second emission intensity based on a maximum video signal value contained in a calculation area corresponding to the small-areas.

5. The apparatus according to claim 3, wherein the first calculation unit calculates the second emission intensity based on a center value between a maximum value and a minimum value of lightness in video signals contained in a calculation area corresponding to the small-areas.

6. The apparatus according to claim 3, wherein the first calculation unit calculates the second emission intensity based on an average value of luminance in video signals contained in a calculation area corresponding to the small-areas.

* * * * *